United States Patent [19]

Kowatsch

[11] Patent Number: 4,784,404

[45] Date of Patent: Nov. 15, 1988

[54] SAFETY SKI BINDING CAPABLE OF RELEASING SIDEWAYS

[75] Inventor: Ulrich Kowatsch, Leonberg, Fed. Rep. of Germany

[73] Assignee: Geze Sport International GmbH, Leonburg, Fed. Rep. of Germany

[21] Appl. No.: 14,509

[22] Filed: Feb. 13, 1987

[30] Foreign Application Priority Data

Feb. 19, 1986 [DE] Fed. Rep. of Germany ..... 3605313

[51] Int. Cl.[4] ..... A63C 9/085

[52] U.S. Cl. ..... 280/629; 280/633; 280/634; 280/636

[58] Field of Search ..... 280/625, 626, 628, 629, 280/633, 634, 636

[56] References Cited

U.S. PATENT DOCUMENTS

| | | | |
|---|---|---|---|
| 4,027,897 | 6/1977 | Hildebrand | 280/625 |
| 4,365,822 | 12/1982 | Nitschko et al. | 280/625 |
| 4,434,997 | 3/1984 | Nitschko | 280/628 |
| 4,516,792 | 5/1985 | Scheck et al. | 280/625 |
| 4,538,828 | 9/1985 | Dimier | 280/628 |
| 4,593,928 | 6/1986 | Scheck et al. | 280/625 |
| 4,682,786 | 7/1987 | Peyre | 280/628 |

FOREIGN PATENT DOCUMENTS

| | | | |
|---|---|---|---|
| 300630 | 8/1972 | Austria | 280/623 |
| 2358282 | 6/1974 | Fed. Rep. of Germany | 280/625 |
| 2401152 | 7/1975 | Fed. Rep. of Germany | 280/625 |
| 3041545 | 10/1982 | Fed. Rep. of Germany | 280/625 |
| 3230186 | 2/1984 | Fed. Rep. of Germany | 280/628 |

*Primary Examiner*—David M. Mitchell
*Assistant Examiner*—Brian L. Johnson
*Attorney, Agent, or Firm*—Townsend & Townsend

[57] ABSTRACT

A safety ski binding for holding the tip of a ski boot and capable of releasing sideways has two side jaws (13, 14) which hold the ski boot at the sides; a sole hole-down member (15), and a release spring (11) which extends substantially in the longitudinal direction of the ski. The release spring is braced at one of its ends against the binding housing (12) which is fixedly mounted to the ski and acts at its other end on the sideways release mechanism which a forwardly directed force. The sole hold-down member (15), the side jaws (13, 14), the sideways release mechanism and the point of action (16) of the release spring (11) are arranged on a carrier (18) which is pivotable upwardly relative to the binding housing (12) about a transverse axle (17). The transverse axle (17) is located at a distance (A) above the line of action (19) of the release spring (11) such that a predetermined hold-down force originating from the release spring (11) acts from the upper side on the sole (42) of the ski boot.

7 Claims, 2 Drawing Sheets

SAFETY SKI BINDING CAPABLE OF RELEASING SIDEWAYS

Figure 1:
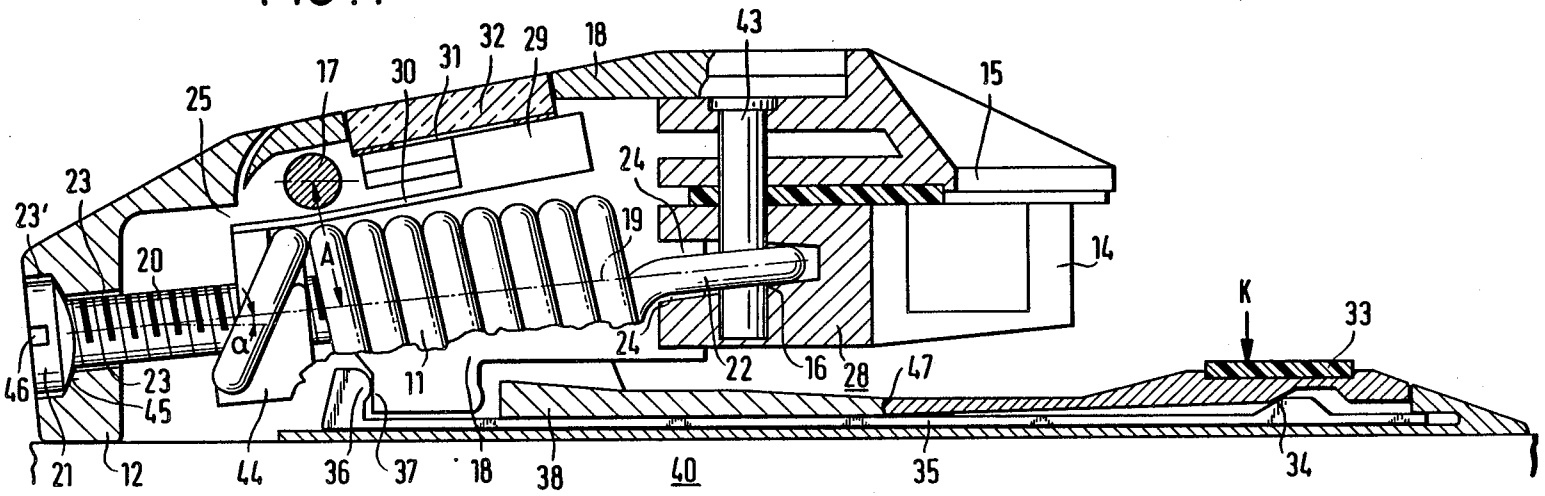

A safety ski binding capable of releasing sideways, in particular for holding the tip of the ski boot, the ski binding comprising two side jaws which hold the ski boot at the sides; a sole hold-down member; and a release spring which extends substantially in the longitudinal direction of the ski and is braced at its one end against the binding housing, which is fixed relative to the ski, and wherein the other end of the release spring acts on the sideways release mechanism with a force which is directed away from the ski boot, in particular in a forward direction.

A releasing toe unit for ski bindings is already known (Austrian Pat. No. 300 630) in which a sole hold-down member which can deflect resiliently upwardly against the bias of the spring is arranged on a toe unit which is capable of releasing sideways. This is intended to prevent the ski boot from exerting abnormal loads on the binding and the ski, for example when a layer of snow lies between the boot and the ski, and in this way changing the operating characteristics of the binding. The disadvantage of this known ski binding is the requirement for a special hold-down spring.

It is also already known (German laying open print No. 32 30 186) to derive the resilient hold-down force which acts on the toe hold-down member from the release spring which extends in the longitudinal direction of the ski. However, it is necessary for this purpose to allow one end of the release spring to act on the sole hold-down member and to allow the other end of the release spring to act on the sideways release mechanism. For this the front end of the release spring including the components which support it must also be movable and this is a disadvantage both constructionally and also in operation.

The principal object underlying the present invention is to provide a safety ski binding of the initially named kind in which one and the same end of the release spring, and indeed preferably the end facing the ski boot, in particular the rear end of a release spring preferably constructed as a tension spring, provides both the force which acts on the sideways release mechanism and also the hold-down force for the sole hold-down member.

In order to satisfy this object the invention provides that the sole hold-down member, the side jaws, the sideways release mechanism and the point of action of the release spring on the sideways release mechanism are arranged on a carrier which can pivot upwardly about a transverse axle relative to the binding housing; and that the transverse axle is located at a distance above the line of action of the release spring such that a predetermined resiliently yielding hold-down force originating from the release spring acts on the sole of the ski boot from the upper side.

Thus, in accordance with the invention, the binding housing which is fixedly mounted on the ski is restricted to the part which supports the front end of the tension spring and side cover parts, whereas the remaining part of the binding is pivotable on the binding housing about a specially disposed transverse axle. In this way the release spring generates a torque about the transverse axle which tries to move the sole hold-down member downwardly.

Thus, as a result of the construction of the invention the same end of the release spring, i.e. for a tension spring the rear end, brings about both the actuation of the sideways release mechanism and also the pressing down of the sole hold-down member onto the sole of the ski boot. The front end of the release spring which is braced against the binding housing does not need to execute axial movements during the operation of the binding, but must instead simply be free to take part in the movements which occur on eventual upward pivoting of the sole hold-down member. In this way the front end of the release spring is also available for adjustment of the bias, for example by means of a threaded bolt connection.

As a result of the construction of the invention not only are the disadvantages brought about by a layer of snow between the sole of the ski boot and the ski avoided, in particular jamming of the sole of the ski boot, but in addition a restricted friction compensation is also obtained. If, namely, the skier moves into a rearward position the friction at the sole hold-down member is admittedly somewhat increased, however, the friction at the sole plate is simultaneously considerably reduced so that the sideways release is not made more difficult, but is instead made somewhat easier, which is entirely desirable in the case of a rearward fall.

A preferred dimensioning of the distance between the transverse axle and the line of action of the release spring, taking account of the distance of the sole hold-down member from the transverse axle, results in the predetermined hold-down force lying between 100 and 300 N, preferably between 150 and 250 N, and in particular at approximately 200 N.

As a result of the construction of the invention relative movements occur, depending on the degree of upward pivoting of the sole hold-down member, between the release spring and the carrier and also the binding housing. These relative movements mean that it is advantageous for adequate free space to be provided around the release spring, around its abutments and around its mounting ends so that the release spring which is braced against the binding housing, and also the abutments and mounting ends of this spring, can participate unhindered in the displacements and pivotal movements which occur on upward pivoting of the carrier. The range of pivotal movement of the carrier relative to the binding housing does not have to be particularly large. It is sufficient for all practical cases for the range of upward pivotal movement of the carrier to be restricted so that the vertical movability of the sole hold-down member amounts to from 2 to 8 mm, in particular to from 3 to 7 mm, and preferably from 4 to 6 mm.

In order for the release spring to pass without problem beneath the transverse axle of the invention it is expedient for the release spring to be slightly downwardly inclined from the rear to the front. The arrangement should in particular be such that the angle of inclination of the line of action relative to the horizontal amounts to from 2° to 8°, and in particular to approximately 5°.

It is particularly preferred for the sideways release mechanism to consist of two laterally disposed vertical tilt edges formed on the carrier and cooperating tilting surfaces of a tiltable sole clamp. With an arrangement of this kind both the sole hold-down member and also the side jaws are connected in form-locked manner with the tiltable sole clamp. However, the sole hold-down member could also basically be mounted in form-locked manner on the carrier part while only the side jaws are pivotable outwardly against the force of the release spring.

While a compression spring could also basically be used as a release spring, with the reversal of the force direction being achieved by a draw rod, it is however preferable for the release spring to be a tension spring which is secured at the rear to the sideways release mechanism and at the front to the binding housing.

If the safety binding of the invention is used with a ski boot having a thicker ski sole than that for which it was initially adjusted the release spring of would be stretched to a somewhat greater degree which could lead to an increase of the release force. In order, in this case, to provide a corresponding indication of the increased sideways release force a further embodiment of the invention is characterised in that a holding arm, which extends towards the ski boot beyond the transverse axle to an indicator slider, is mounted at the adjustable end of the release spring; and in that the indicator slider is located beneath a viewing window in the upper side of the carrier, wherein the viewing window is provided with a spring bias adjustment scale.

As the carrier and the indicator slider pivot about different axes during upward pivotal movement of the carrier this upward pivotal movement of the carrier results in a relative displacement between the indicator slider and the spring bias adjustment scale, such that the increased bias force of the release spring which occurs on upward pivotal movement of the sole hold-down member is indicated. The bias of the release spring can thus be appropriately readjusted on using a thicker or thinner ski boot sole. A further thought underlying the invention is thus to be seen in the fact that the indicator slider is not only moved relative to the indicator scale on adjusting the bias of the release spring by hand by means of the adjustment screw but also in the same sense, and in the same proportion, by small upward pivotal movements of the sole hold-down member. The indicator slider thus delivers in each case an indication of the actual bias of the release spring which is sufficient for all practical purposes.

While the friction compensation for a rearward position of the skier functions in a troublefree manner with the above described embodiments, an increase in the friction occurs with forward positions of the skier. This arises because the sole hold-down member which follows the forward movement of the skier and is guided downwardly still presses against the sole of the ski boot from above with a substantially unchanged force, while the frictional force between the sole of the ski boot and the sole plate arranged on the ski increases. This influence can admittedly be greatly reduced by using a sole plate with a low coefficient of friction. However, it is preferable for a reduction of the level of friction at the sole plate not to be necessary.

This can be avoided by using an embodiment which is characterised in that a vertically movable foot plate is arranged on the upper side of the ski in the ball region of the ski boot and is connected via a force-deflecting transmission to a longitudinal slider extending beneath the sole of the ski boot and the binding in such a way that on the exertion of a treading force from above on the foot plate a force is exerted on the slider towards the ski boot, in particular a rearwardly directed force; and in that the end of the slider remote from foot plate engages by means of an abutment behind a counter-abutment of the carrier in such a way that on exertion of the treading force on the foot plate a pivotal moment about the transverse axle is exerted on to the carrier which tries to pivot the sole hold-down member upwardly, with the upward pivoting force exerted on the carrier via the force-deflecting transmission however being so restricted that it is always smaller than the hold-down force exerted by the release spring.

As a result of this construction the force with which the sole hold-down member is pressed onto the sole of the ski boot from above is progressively reduced with increasing pressure on the sole plate, so that the increasing frictional force between the sole of the ski boot and the sole plate is offset by a correspondingly reducing frictional force between the sole hold-down member and the upper side of the ski boot sole.

It is particularly expedient if the upward pivoting force exerted on the carrier by the treading force is at most approximately the same as the hold-down force generated by the release spring as a result of suitable construction of the force-deflecting transmission. In this manner it is possible to ensure that the frictional forces between the sole of the ski boot and the sole plate and sole hold-down member remain substantially the same, both with an extreme rearward position of the skier and also an extreme forward position of the skier. As the frictional forces are higher for a normal position of the skier on the ski, in which the ski sole is practically clamped between the sole hold-down member and the sole plate, and as the sideways release mechanism is adjusted taking acount of these frictional forces, sideways release is made easier in the desired manner both with an extreme forward position and also with an extreme rearward position of the skier.

Figure 2:
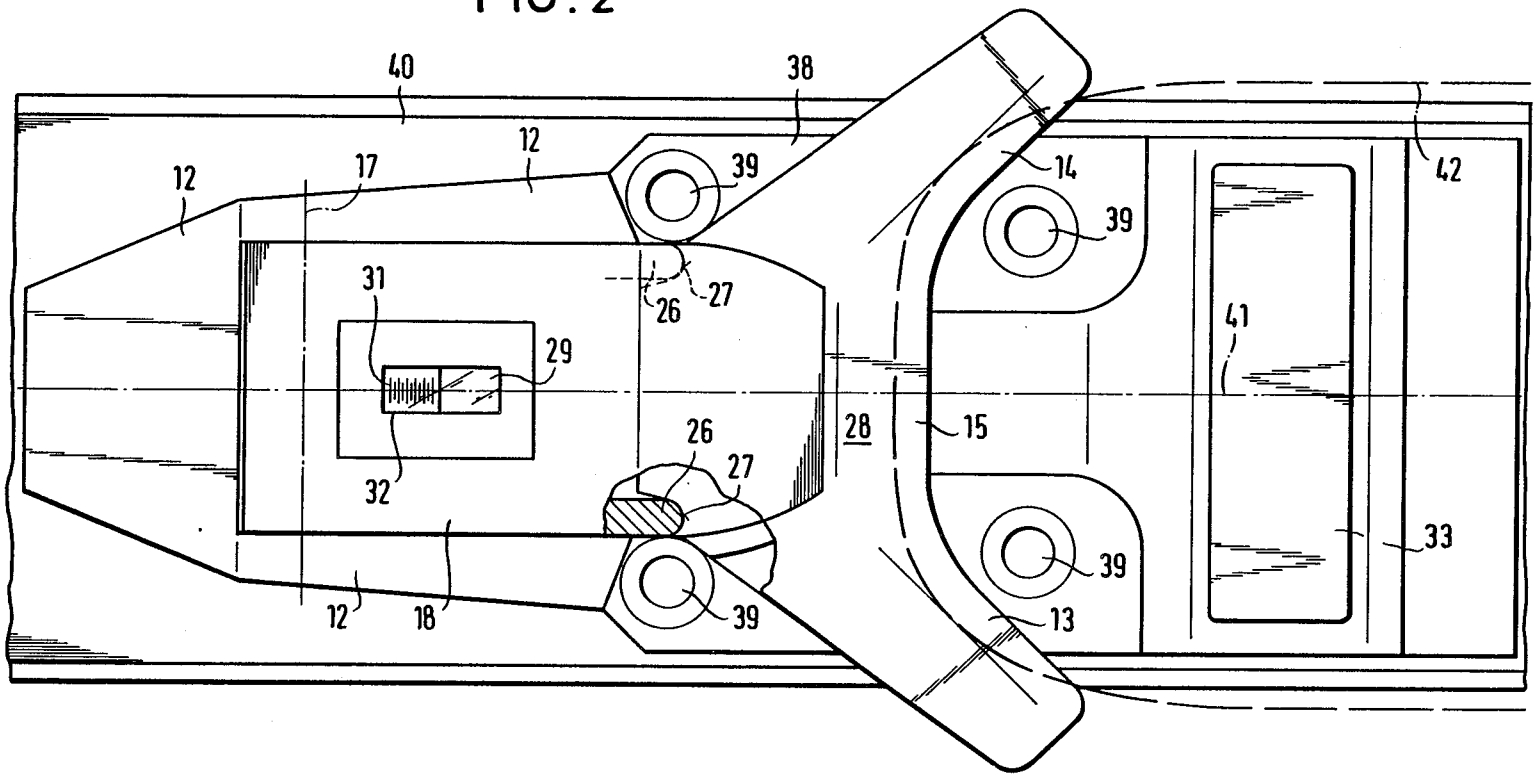

The invention will now be described in the following by way of example and with reference to the drawings which show:

FIG. 1 a partly sectioned sideview of a ski safety binding in accordance with the invention for holding the tip of a ski boot, and FIG. 2 a plan view of the safety ski binding of FIG. 1.

As seen in FIGS. 1 and 2 a base member 38 of a binding is secured to a ski 40 by means of securing screws which pass through four screw holes 39. In the front region the binding housing 12 is located on the base member 38. In accordance with the invention the binding housing 12 is cut-away in a U-shaped manner in plan view in order to provide space for a carrier 18 which is inserted there and which has substantially the shape of parallelopiped. The carrier 18 is pivotally mounted on the binding housing 12 about a transverse axle 17 provided at the top in the front region of the binding housing 12.

In accordance with FIG. 2 the carrier 18 has vertically extending rounded tilting edges or noses 26 in the rear region on both sides of the central longitudinal axis 41 of the binding. These tilting noses cooperate with groove-like recessed tilting surfaces 27 of complementary shape of a tiltable sole clamp 28, which carries, at the center, the sole hold-down member 15 which bears on the sole 42 of the ski shoe (shown in broken lines) and, to the sides thereof, the obliquely outwardly projecting side jaws 13, 14.

The front mounting end 22 of a release spring 11 which extends substantially in the longitudinal direction is secured to a retaining bolt 43 which passes vertically through the sole clamp at the center. The release spring is inclined slightly downwardly in the direction away from the sole 42 of the ski boot in the manner shown in FIG. 1 in such a way that the angle $\alpha$ of the line of action 19 of the release spring 11 to the horizontal amounts to approximately 5°. The front end of the release spring is secured to an abutment 44 constructed as a nut. An abutment bolt 20 is screwed into the nut 44 and passes with play 23 on all sides through a bore in the front wall of the binding housing 12 and terminates in an abutment bolt head 21. The abutment bolt head 21 has a partly spherical rear side which is journalled in a partly spherical bearing surface 45 of complementary shape in such a way that the tension forces exerted by the release spring 11 are transmitted to the binding housing 12. A certain degree of pivotal movement of the abutment bolt 20 is made possible by the play 23, by the partly spherical bearing surface 45 and by the lateral play 23' alongside the head 21 of the abutment bolt. The head 21 of the abutment bolt is provided at its outer end with a slot 46 for the engagement of a screw driver or a coin. By rotating the head 21 of the abutment bolt the abutment nut 44 can be displaced substantially in the axial direction, whereby the bias of the release spring 11 can be changed.

In order to make free movement possible between the release spring 11 and the components that are connected therewith on upward pivoting of the carrier 18 it is expedient to provide not only the free spaces 23, 23' but also further free play spaces 24, 25 as shown in FIG. 1.

A holding arm 30 is secured to the upper edge of the abutment nut 44 below the transverse axle 17. The holding arm 30 extends rearwardly beneath the transverse axle 17 and carries an indicator slider 29 at its end. The indicator slider lies below a viewing window 32 which is mounted behind the transverse axle 17 in the upper wall of the carrier 18. A spring bias adjustment scale 31 is located at the bottom side of the viewing window 32.

A foot or sole plate 33 which extends substantially across the ski 40 is arranged beneath the ball region of the sole 42 of the ski boot. The plate 33 is vertically movable to a small degree beneath the sole hold-down member 15 as a result of the provision of a rotary bearing 47. A pressure force K acting from above on the sole plate 33 is transmitted, via a force deflecting transmission or mechanism 34 formed by cooperating inclined surfaces at the lower side of the sole plate 33 and on a slider 35, in a desired ratio to the slider 35. The slider 35 is mounted so that it is displaceable in the longitudinal direction of the ski within the binding member 38 beneath the sole plate 33. This force tries to push the slider 35 rearwardly.

The front end of the slider 35 extends approximately to beneath the transverse axle 17 where an abutment 36 is mounted which projects upwardly by a small amount and engages with a counter-abutment 37 in the lower region of the carrier 18 from the front. The engagement between the abutment 36 and the counter-abutment 37 is such that a force acting rearwardly on the slider 35 transmits a torque about the transverse axle 17 to the carrier 18, with this torque trying to lift the sole hold-down member 15.

As a result of the construction of the invention the tiltable sole clamp 28 together with the components arranged thereon, the retaining bolt 43 and the point of action 16 for the securing end 22 of the release spring 11 are pivoted upwardly on upward pivotal movement of the carrier 18. The spring 11 is however only able to participate in part in such a pivotal movement because its front end is fixed to the binding housing 12. On upward pivotal movement of the carrier 18 the relative position of the release spring 11 to the carrier 18 and to binding housing 12 thus changes.

The manner of operation of the safety ski binding is as follows:

The basic adjustment of the binding relative to the thickness of the sole 42 of the ski boot is such that the sole of the ski boot inserted into the binding is clamped between the sole plate 33 and the sole hold-down member 15 in the vertical direction, so that a force of for example 200 N acts on the sole of the ski boot from above and from below.

If the skier moves into a backward position the sole hold-down member 15 is increasingly loaded from below and the sole plate 33 is increasingly relieved. Frictional force between the sole 42 of the ski boot and the sole plate 33 reduces as a result whereas the frictional force between the sole hold-down member 15 at the upper side of the sole 42 of the ski boot remains approximately the same or increases slightly. Lateral release is thus made correspondingly easier.

If the skier should move into a forward position the force K exerted on the sole plate exceeds a value of 200 N. The portion of the force which exceeds the normal force of 200 N increasingly relieves the sole hold-down member 15 which is pressed downwardly, i.e. works against the downward holding force of the release spring 11. For the maximum force K the relieving torque exerted by the slider 35 on the carrier 18 should be not quite as large as the hold-down moment exerted by the release spring 11, so that for the maximum force K the top of the sole 42 of the ski boot is approximately relieved from the downward holding force of the sole hold-down member 15. The increase in friction between the sole 42 of the ski boot and the sole plate 33 is thus at least compensated for by a reduction in the friction between the sole hold-down member 15 and the sole 42 of the ski boot.

Furthermore, it is important that on upward pivotal movement of the sole hold-down member 15, and thus of the carrier 18, a relative displacement occurs between the indicator slider 29 and the adjustment scale 31 in the sense that the increased bias force of the release spring 11 brought about by the upward pivotal movement of the sole hold-down member 15 is indicated in the viewing window 32 on the adjustment scale 31. Thus, should a boot with a thicker ski boot sole 42 be inserted into the binding the increased bias of the release spring 11 which results in this way is indicated and can be compensated for in the desired manner by rotation of the abutment bolt 20. It is important that the line of action 19 of the release spring 11 has a distance A from the transverse axle 17, whereby a lever arm is formed which makes it possible for the release spring to exert a torque on the carrier 18 which holds down the sole hold-down member 15. This torque can be adjusted to a desired value by suitable choice of the size of the distance A.

What is claimed is:

1. A safety ski binding for releasably securing a ski boot having a sole to a ski having an upwardly facing surface to which the binding is mounted, the binding comprising:

a housing adapted to be mounted to the ski surface;

a carrier including a laterally releasable sole hold-down member adjacent a first end of the carrier;

horizontal pivot means operatively coupling the carrier to the housing and permitting relative pivotal movements between the carrier and the housing about an axis generally parallel to and spaced from the ski surface;

a spring abutment piece;

a spring-to-hold-down member coupler; and spring means comprising a coiled spring having a first operative end coupled by said spring-to-hold-down member coupler with the hold-down member, and a second operative end coupled by said spring abutment piece with the housing, so that spring means opposes the lateral release of the hold-down member by applying a corresponding spring force which acts between the hold-down member and the housing, the spring means being further arranged so that its force pivotally biases the carrier and the hold-down member about the horizontal pivot means in the direction of the ski surface, said spring-to-hold-down member coupler permitting the first end of said coiled spring to move with the carrier and the hold-down member when the carrier and the hold-down member pivot about the horizontal pivot means;

whereby the spring means biases the hold-down member in the direction of the ski surface and thereby enables it to grasp ski boot soles of varying thicknesses in addition to yieldingly opposing the lateral release of the hold-down member.

2. A ski binding according to claim 1, wherein said coiled spring is disposed between and spaced from both the horizontal pivot means and the upwardly facing ski surface.

3. A ski binding according to claim 1, including means for adjusting the force generated by the spring means.

4. A ski binding according to claim 1, wherein the horizontal pivot means provides said sole hold-down member with a range of generally vertical movement relative to the ski surface in the range of about 2 mm to about 8 mm, accommodating thereby ski boot soles of varying thickness.

5. A ski binding according to claim 1, including:

a sole plate adapted to be positioned between the upwardly facing ski surface and the ski boot sole, the plate being positioned so that the ski boot sole exerts a downwardly acting force onto the sole plate; and a release mechanism operatively coupled with the sole plate and the carrier and responsive to the magnitude of the downwardly acting force applied to the sole plate for adjusting the magnitude of the force with which the spring means biases tee hold-down member towards the ski surface as a function of the downwardly acting force applied to the sole plate.

6. A ski binding according to claim 5, wherein the downwardly acting force upon said sole plate required to release the binding lies between 100 N and 300 N.

7. A safety ski binding for releasably securing a ski boot having a sole to a ski having an upwardly facing surface to which the binding is mounted, the binding comprising:

a housing adapted to be mounted to the ski surface;

a carrier including a laterally releasable sole hold-down member adjacent a first end of the carrier;

horizontal pivot means operatively coupling the carrier to the housing and permitting relative pivotal movements between the carrier and the housing about an axis generally parallel to and spaced from the ski surface;

an abutment piece;

a spring-to-hold-down member coupler; and spring means comprising a coiled spring having a first operative end coupled by said spring-to-hold-down member coupler with the hold-down member, and a second operative end coupled by said spring abutment piece with the housing, so that the spring means opposes the lateral release of the hold-down member by applying a corresponding spring force which acts between the hold-down member and the housing, the spring means being further arranged so that its force pivotally biases the carrier and the hold-down member about the horizontal pivot means in the direction of the ski surface, said spring-to-hold-down member coupler permitting the first end of said coiled spring to move with the carrier and the hold-down member when the carrier and the hold-down member pivot about the horizontal pivot means; and said coiled spring is inclined relative to the ski surface at an angle lying between 2° and 8°;

whereby the spring means biases the hold-down member in the direction of the ski surface and thereby enables it to grasp ski boot soles of varying thicknesses in addition to yieldingly opposing the lateral release of the hold-down member.

* * * * *